US005967430A

United States Patent [19]

Getzmann

[11] Patent Number: 5,967,430

[45] Date of Patent: Oct. 19, 1999

[54] DISPERSING DEVICE AND PROCESS

[76] Inventor: Hermann Getzmann, Biebersteiner Str. 17, D-51580 Reichshof, Germany

[21] Appl. No.: 09/029,838

[22] PCT Filed: Sep. 5, 1996

[86] PCT No.: PCT/DE96/01695

§ 371 Date: Mar. 9, 1998

§ 102(e) Date: Mar. 9, 1998

[87] PCT Pub. No.: WO97/09115

PCT Pub. Date: Mar. 13, 1997

[30] Foreign Application Priority Data

Sep. 9, 1995 [DE] Germany ..... 195 33 369

[51] Int. Cl.[6] ..... B02C 17/16

[52] U.S. Cl. ..... 241/29; 241/172

[58] Field of Search ..... 241/46.11, 46.13, 241/46.15, 46.17, 142, 170, 172, 27, 29, 286

[56] References Cited

U.S. PATENT DOCUMENTS

| | | | |
|---|---|---|---|
| 3,210,016 | 10/1965 | Sevin et al. | 241/172 |
| 3,601,322 | 8/1971 | Szegvari | 241/46 |
| 3,826,435 | 7/1974 | Pujol | 241/171 |
| 3,892,364 | 7/1975 | Lomasney | 241/15 |
| 3,957,210 | 5/1976 | Durr | 241/46.02 |
| 3,989,272 | 11/1976 | McCanse et al. | 280/460 |
| 4,044,957 | 8/1977 | Schold | 241/46.11 |
| 4,089,473 | 5/1978 | John | 241/41 |
| 4,741,482 | 5/1988 | Damm et al. | 241/46.17 |
| 5,346,147 | 9/1994 | Ishikawa et al. | 241/172 |
| 5,662,279 | 9/1997 | Czekai et al. | 241/21 |

FOREIGN PATENT DOCUMENTS 0526699 2/1993 European Pat. Off. .

*Primary Examiner*—Joseph J. Hail, III
*Assistant Examiner*—Susan R. Kingsbury
*Attorney, Agent, or Firm*—Diller, Ramik & Wight, PC

[57] ABSTRACT

In order to reduce the conversion and cleaning effort between pre-dispersion by a dissolver (2) and fine dispersion by an agitating ball mill (3), it is proposed to combine both devices in a single container. The casing (31) of the agitating ball mill (3) is in the form of a toroidal annular channel with a central hole (34). The drive shaft (21) of the dissolver (2) runs through said central hole (34) in the agitating ball mill (3). Dispersion may take place in the dispersing device simultaneously or in succession. The agitating ball mill (3) is preferably lowered inside the container (1) along the common axis after a pre-determined time and caused to act on the substance to be dispersed (5).

33 Claims, 4 Drawing Sheets

DISPERSING DEVICE AND PROCESS

BACKGROUND OF THE INVENTION

The invention relates to a dispersing device consisting of a container for accommodating and processing a substance to be dispersed, a flow generator driven by a first shaft, a grinding device containing a grinding medium and having a casing with openings, through which the substance to be dispersed can pass due to the flow generated by the flow generator, and an agitator mounted inside the housing which can rotate relative to it. The invention also relates to a process for the pre-dispersion and fine dispersion of a fine to very fine, solid particulate material in a dispersant in a container for accommodating the substance to be dispersed, where pre-dispersion is performed using a dissolver and fine dispersion using an agitating ball mill.

A device of this kind disperses fine to very fine, solid particulate constituents in the liquid phase.

Three sub-steps occur simultaneously during the dispersion process:

1. Wetting of the surface of the solid material to be incorporated by the liquid constituents of the mill base, 2. Mechanical separation of agglomerates into smaller agglomerates and primary particles, and 3. Stabilization of primary particles, agglomerates and aggregates to prevent renewed clumping (flocculation).

Although the following description primarily relates to the dispersion of paints and coatings, this processing technique can also be applied in a similar manner in other fields (e.g. biology, food processing technology, pharmacy, agrochemistry, ceramics industry and the like).

When dispersing paints, for example, it is of economic interest to minimize the use of relatively expensive primary colorant particles. The better the dispersion, the more intense are the colour effect and gloss. Thus, good dispersion can reduce, for example, the use of expensive primary colorant particles by using cheaper secondary particles. In the ideal situation, each primary particle is wetted separately.

A dispersing device which exhibits the characteristics of this generic description is known from EP 526 699 A1.

A grinding device of this kind is also known from U.S. Pat. No. 5,184,783. This patent specification presents an agitating submersible mill which disperses according to the circulation process. It essentially consists of a wear-resistant strainer filled with grinding balls which is submerged in a double-walled container. A cylindrical drive shaft runs through the centre of the strainer. This drive shaft drives the bar-shaped agitator mounted inside the strainer. The walls of the strainer exhibit sieve-like perforations.

In order to enable the circulation of the grinding medium through the strainer, the drive shaft drives a flow generator in addition to the agitator. This flow generator must be positioned outside the strainer in order to ensure adequate flow. Thus, the drive shaft penetrates the strainer. A separating and sealing system is fitted at the point of penetration to prevent the grinding media from escaping from the strainer.

The central position of the flow generator has definite advantages in terms of fluid mechanics, because it ensures uniform circulation throughout the container.

However, in order to carry out an economical dispersion process using the dispersing device known from the prior art, the substance to be dispersed must be pre-dispersed.

Pre-dispersion is preferably performed using a dissolver disk due to the fact that optimum pre-dispersion is indispensable from an economic standpoint, particularly in the case of agglomerates which are difficult to disperse and require the use of the grinding device during subsequent processing. An inadequately pre-dispersed product not only necessitates longer running times of the grinding unit known from the prior art, but it also frequently happens that the desired fineness is not attained. As a rule, faults or errors in pre-dispersion cannot be compensated for by other systems, particularly because inadequately pre-dispersed products clog the holes in the strainer during subsequent use of the grinding device, thus hindering, or even completely stopping, circulation through the strainer.

However, the dissolver can often achieve only pre-dispersion, i.e. the substance to be dispersed can only be dispersed up to a certain degree of fineness. An agitating ball mill or similar grinding device must be used for further dispersion, or "fine dispersion".

When switching from pre-dispersion to fine dispersion, either the container with the substance to be dispersed, the respective drive unit for the machine, or the attachments must be exchanged, or the substance to be dispersed must be pumped out of the container and into a separate agitating ball mill.

In addition, the entire installation must be cleaned when switching products—a change from red paint to white paint, for example. When cleaning the ball mill, it is very difficult to clean the separating and sealing system. The conversion and cleaning processes thus cause extensive idle times and costs.

SUMMARY OF THE INVENTION

Thus, the task of the present invention is to further develop the dispersing device known from the prior art such that processing is substantially simplified and the cleaning effort reduced.

According to the invention, this task is solved in that the flow generator has means for dispersion, the height of the grinding device can be adjusted relative to the flow generator, and that the grinding device can be submerged into the substance to be dispersed and fully retracted again using the height adjustment feature, while the flow generator remains in the substance to be dispersed.

In a preferred configuration of the dispersing device according to the invention, the casing of the annular channel has an open profile and the agitator can be connected to the shaft by way of at least one connecting web running through the open profile.

In the design of the dispersing device according to the invention, the drive shaft of the flow generator can run centrally along the axis of rotation of the strainer. This retains the flow-related advantage of the central position of the flow generator.

The use of the separating and sealing system can be eliminated completely, as the casing of the grinding device is not penetrated by the shaft. The grinding device can be cleaned far more easily and quickly.

In a another advantageous design of the dispersing device according to the invention, the casing of the annular channel has an open profile, the agitator can be driven by a second shaft and the agitator can be connected to another shaft by way of at least one connecting web running through the open profile.

The additional shaft is preferably designed as a hollow shaft which surrounds the shaft of the flow generator. In this way, the external hollow shaft can drive the agitator mounted inside the casing of the grinding device in a particularly simple manner, independent of the speed of the drive shaft of the flow generator. Both shafts can be driven simultaneously or separately from one another, or even in opposite directions. Naturally, kinematic reversal is also possible inside the grinding device, i.e. the entire grinding device can be rotated relative to the stationary agitator.

The agitator can be designed as desired, depending on the dispersion task. For example, it can be designed as a ring-shaped disk, a perforated ring-shaped disk, a slotted disk or as pins and the like.

The agitator preferably has at least one ring-shaped disk running coaxially to the annular channel and extending through it. The agitator thus ensures continuous movement of the grinding medium in the casing.

In another advantageous design of the invention, the flow generator has means for dispersion. In this context, it is particularly advantageous if these means for dispersion are designed as a dissolver disk. The dissolver disk then generates the flow required for the operation of the dispersing device, on the one hand, and also pre-disperses the grinding medium. The dissolver disk fulfils a particularly important task for dispersion, namely the uniform circulation of the product all the way to the peripheral zone of the mixing container. A dissolver disk fulfils the task of dispersion—i.e. the dissolving of agglomerates and the wetting of the primary particles in the liquid phase—in a particularly economic manner, because dispersion is achieved much faster than within the grinding device.

The dispersing device according to the invention is preferably designed such that the grinding device is of adjustable height and can be submerged into the substance to be dispersed and fully retracted again using the height adjustment feature. In this way, the individual processing steps of pre-dispersion and fine dispersion can be carried out completely independently of one another, without having to remove the substances to be dispersed from the container or necessitating conversion of the agitator. Switching between pre-dispersion and fine dispersion can be carried out very quickly and economically. This eliminates the need for separate containers and drive devices for a dissolver and an agitating ball mill.

In the dispersing device according to the invention, both processes—pre-dispersion using the dissolver disk and fine dispersion using the agitating ball mill—can be carried out using the circulation process. In this context, the processes can be performed separately or simultaneously. The latter variation is particularly easy and economical to realise in the dispersing device according to the invention, because there is no need to change the agitating devices or containers between pre-dispersion and the subsequent fine dispersion in the grinding device.

Both shafts are preferably driven by one and the same motor, whereby the operative design is considerably simplified. Suitable transmissions elements are then provided above the dispersing device, which enable both shafts to be driven separately from, or parallel to, one another.

In a particularly preferred configuration of the dispersing device according to the invention, the annular channel has a rectangular cross-section. Naturally, all other suitable cross-section shapes are conceivable for the annular channel, such as a round cross-section. The shape of the cross-section of the annular channel is essentially dependent on the required flow properties.

An example of the invention is illustrated in the drawings and described below based on the drawings.

The drawings show the following:

DESCRIPTION OF THE PREFERRED EMBODIMENTS

Figure 1:
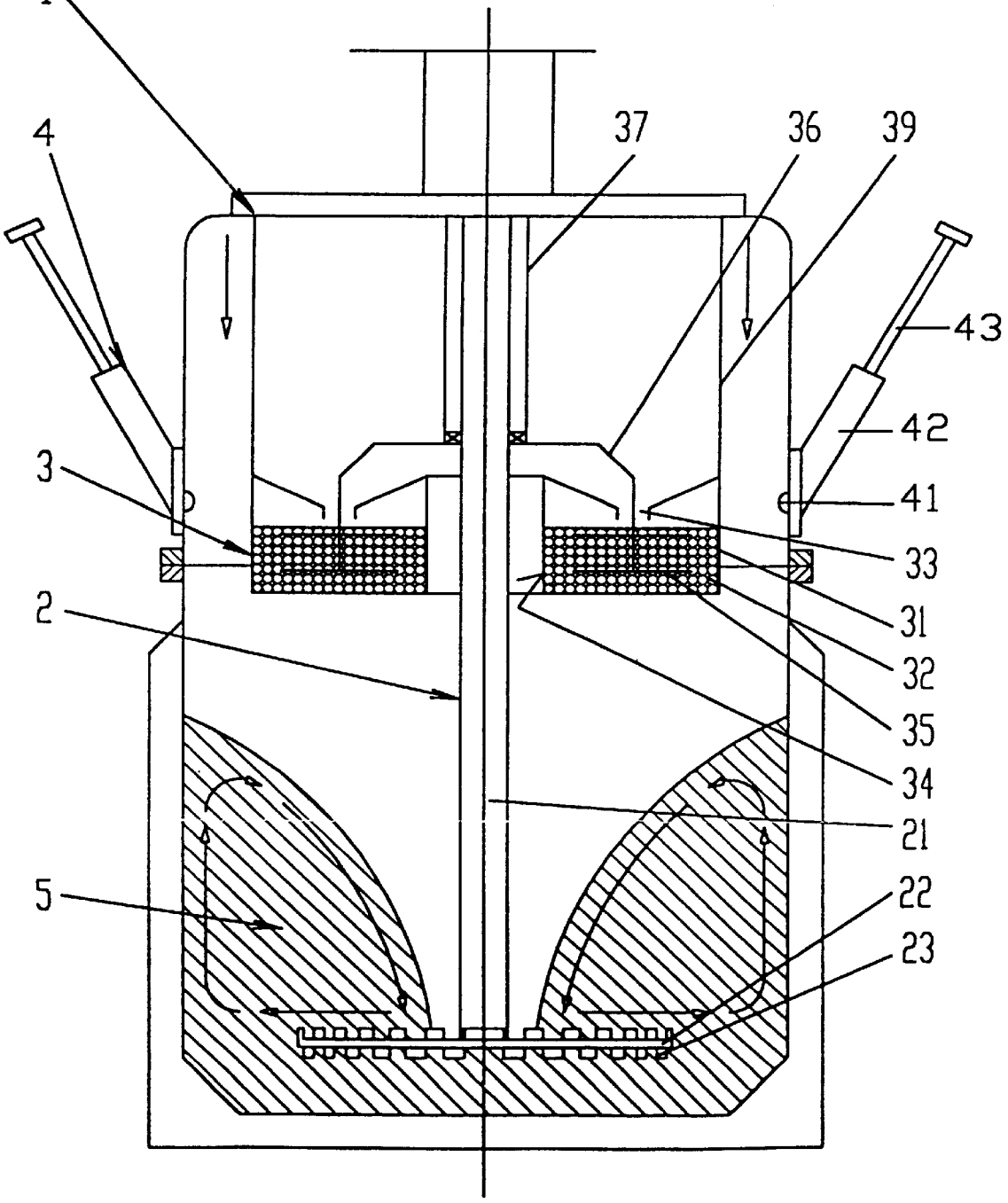
FIG. 1 A front cross-section view of the dispersing device according to the invention during pre-dispersion, FIG. 2 The same view as in FIG. 1 with the agitating ball mill lowered during fine dispersion, FIG. 3 The same view as in FIG. 1 during cleaning of the dispersing device, and FIG. 4 A front view of an alternative configuration of the dispersing device according to the invention.

As shown in FIG. 1, the dispersing device according to the invention consists of an essentially cylindrical, double-walled container 1 closed with a cover, a dissolver 2, an agitating ball mill 3 and several cleaning nozzles 4.

The dissolver consists of a cylindrical shaft 21 which has a dissolver disk 22 on its lower end. The dissolver disk is equipped with several teeth 23 around its perimeter which are alternately bent up and down on the circular disk.

Agitating ball mill 3 consists of a sieve-like perforated casing 31 which holds grinding balls 32. The top side of casing 31 is provided with an opening 33 running all the way around. In the example illustrated, casing 31 is of single-walled design, but can also be alternatively of double-walled, or some other suitable, design.

The casing 31 forms a toroidal annular channel with a central hole 34. Shaft 21 of dissolver 2 runs through this hole 34.

Two ring-shaped disks 35 are located inside the annular channel which run coaxially to the annular channel. Ring-shaped disks 35 are connected to one another by web 36. Web 36 also connects ring-shaped disks 35 to hollow shaft 37. Hollow shaft 37 is driven by a motor (not shown) in the same manner as shaft 21. Hollow shaft 37 and shaft 21 are positioned coaxially relative to one another, where shaft 21 runs inside hollow shaft 37.

The wall of container 1 is provided with the cleaning nozzles 4. Each cleaning nozzle 4 comprises of a spray head 41, a hollow cylinder 42 mounted on the,wall of container 1 and a piston 43, guided inside hollow cylinder 42, which has a spray head 41 on the end facing the centre of container 1.

The perimeter of ball mill 3 is held by bars 39, with which its height can be adjusted using a drive device (not shown). Bars 39 are mounted such that they enable the height of the agitating ball mill 3 to be adjusted, but do not obstruct the rotation of ring-shaped disks 35.

In FIG. 1, agitating ball mill 3 is in its raised position, so that it does not come into contact with the substance to be dispersed. Hollow shaft 37 is not driven in this position. Pre-dispersion is carried out only by the rotation of dissolver 2, the height of which can also be adjusted in order to ensure suitable process conditions. The "doughnut effect" desired in pre-dispersion can be achieved in this way. The circulation of the substance 5 to be dispersed (indicated by arrows) is not obstructed by agitating ball mill 3, so that dissolver 2 performs pre-dispersion efficiently and quickly.

Figure 2:
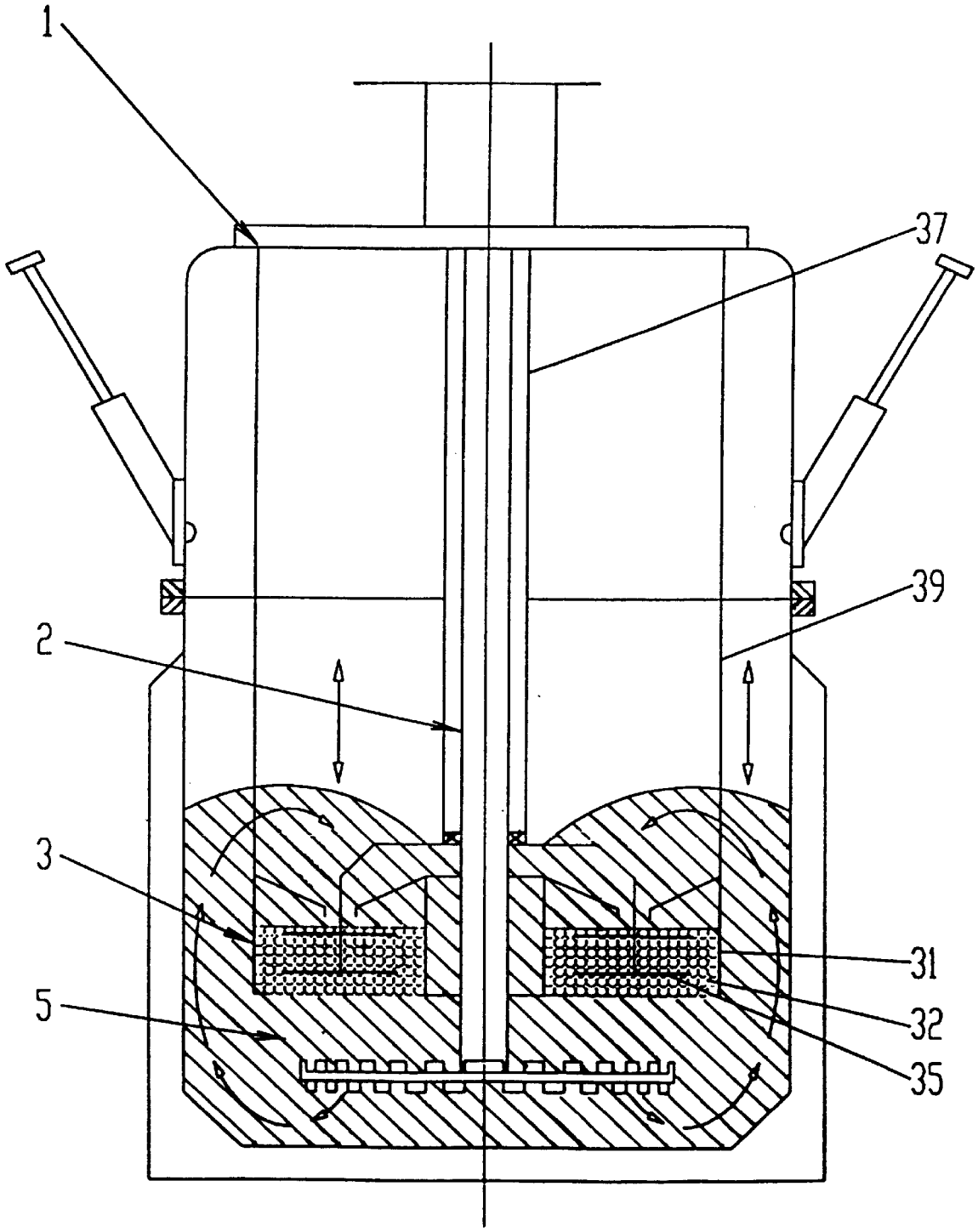

FIG. 2 shows agitating ball mill 3 in its lowered position. The height of agitating ball mill 3 is adjusted inside container 1 using bars 39 and hollow shaft 37 and lowered into the substance 5 to be dispersed. Agitating ball mill 3 is completely submerged in the substance 5 to be dispersed and hollow shaft 37 rotates ring-shaped disks 35 relative to casing 31 of agitating ball mill 3. Ring-shaped disks 35 set grinding balls 32 in motion, thus bringing about the grinding process inside agitating ball mill 3. Dissolver 2 furthermore provides for the circulation (indicated by arrows) of the substance 5 to be dispersed. At this point, however, circulation is also provided by the sieve-like perforated casing 31 of agitating ball mill 3. In this way, agitating ball mill 3 performs fine dispersion by the circulation process.

Figure 3:
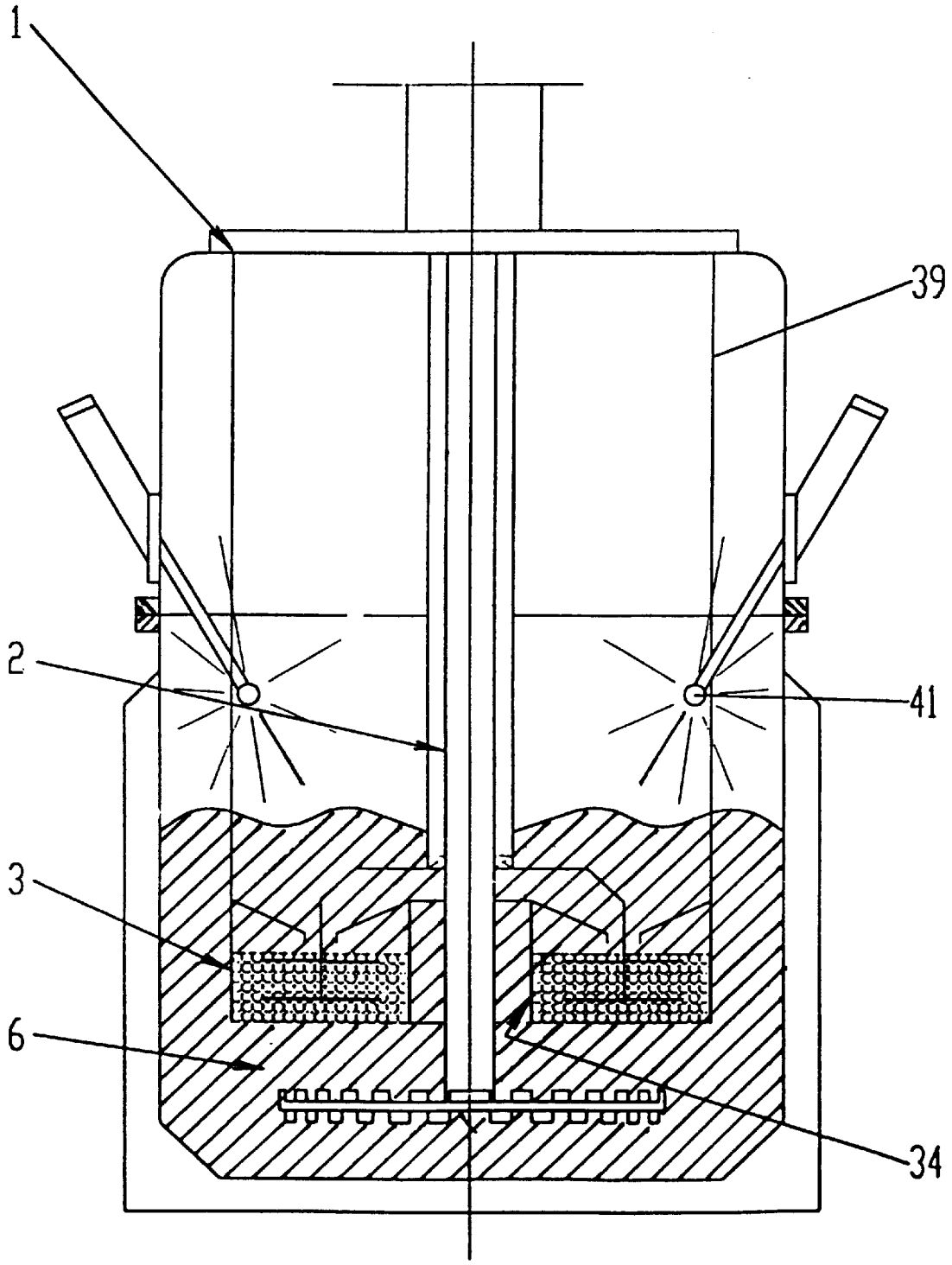

FIG. 3 shows the cleaning of the dispersing device according to the invention after the substance to be dispersed has been pumped out by a suitable pumping device (not shown). For cleaning purposes, spray heads 41 positioned around the wall of container 1 are inserted into the interior of the container. This is achieved by pushing pistons 43 in hollow cylinders 42 axially along their longitudinal axis towards the centre of container 1. Pistons 43 are hollow and feed the cleaning agent through a pressurising device (not shown) to spray heads 41. Spray heads 41 spray the cleaning agent through expediently designed openings into the interior of container 1. In this way, the walls and devices are sprayed first and container 1 fills up with cleaning agent as the process continues. The particles of the substance 5 to be dispersed which are stuck to dissolver 2 and agitating ball mill 3 are loosened from the dispersing device by the cleaning agent. A mixture of cleaning agent and substance 5 to be dispersed—referred to as cleaning fluid 6—forms at the bottom of container 1. Dissolver 2 and agitating ball mill 3 are rotated as before in cleaning fluid 6, but this time for the purpose of cleaning the components. In this context, central hole 34 of agitating ball mill 3 increases—relative to the prior art—the surface area of the casing through which cleaning fluid 6 can enter or pass through the interior of agitating ball mill 3. The cleaning process is thus accelerated by designing agitating ball mill 3 with a central hole 34.

Cleaning nozzles 4 can also be designed such that they extend into the interior of hole 34 in agitating ball mill 3 during the spraying process and thus spray the inner periphery of agitating ball mill 3, or they can be mounted in such a way that they spray the inner and outer periphery of agitating ball mill 3 in alternating fashion. Hollow shaft 21 can also be designed with suitable holes, through which the cleaning agent is sprayed.

Following the cleaning process, cleaning fluid 6 is pumped out, cleaning nozzles 4 are retracted from container 1 and agitating ball mill 3 is moved to its raised position using bar 39. The dispersing device is then ready for operation again.

Figure 4:
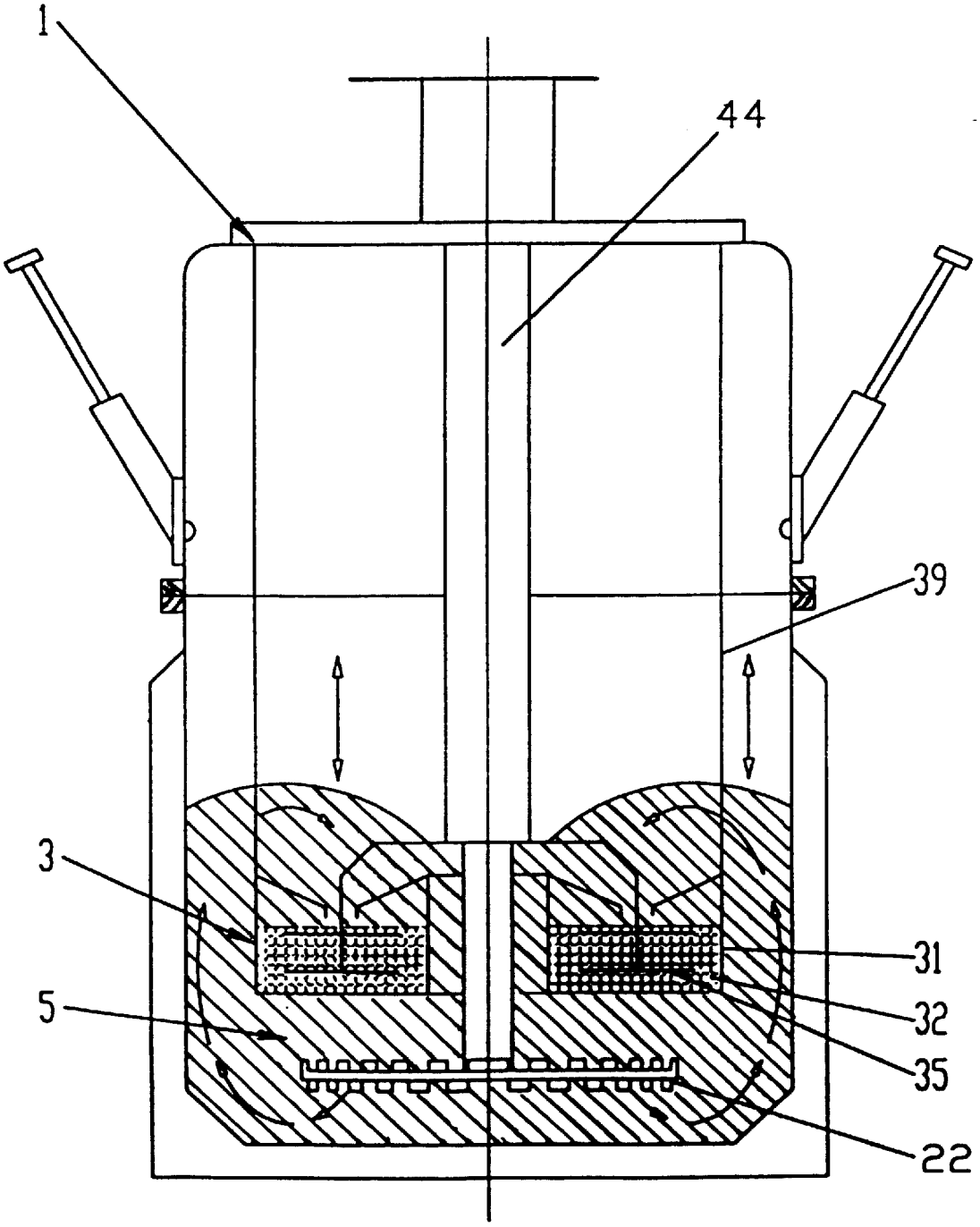

FIG. 4 shows an alternative configuration of the dispersing device according to the invention. A single shaft 44 drives both ring-shaped disks 35 and dissolver disk 22 provided on its bottom end. This configuration represents the simplest and most cost-efficient realisation of the dispersing device according to the invention.

The practical examples presented here all relate to dispersing devices in which the casing is stationary and the agitator is mounted in a rotating manner relative to this casing. It is also within the scope of the invention for the dispersing device to be of kinematically reverse design. In a dispersing device of this kind, the flow generator is designed to be stationary, while the casing is rotated relative to the stationary agitator. The agitator casing and/or the flow generator are driven by suitable drive elements known to a person skilled in the art, e.g. mechanical, electrical or magnetic drives.

The dispersing device according to the invention combines a dissolver and an agitating ball mill in a single device. The advantages gained from the prior art as a result of the flow generator being located in the centre of the container, are retained. The invention also prevents the dissolver drive shaft from penetrating the agitating ball mill. The switch from pre-dispersion to fine dispersion is simplified and accelerated. It is also possible to install both devices in a minimum amount of space as a completely closed system. Thus, solvents cannot escape during process conversions.

Although a preferred embodiment of the invention has been specifically illustrated and described herein, it is to be understood that minor variations may be made in the apparatus without departing from the spirit and scope of the invention, as defined the appended claims.

I claim:

1. A dispersing device comprising a container (1) for accommodating and processing a substance (5) to be dispersed, a flow generator (2) located in said container (1), said flow generator (2) including a rotatable shaft (21) carrying means (22) for effecting flow of the substance (5) upon rotation of said rotatable shaft (21), a grinding device (3) including a perforated casing (31) housing grinding means (32, 35) for grinding the substance (5), and means (39) for selectively variably adjusting the relative distance between said grinding device (3) and said flow effecting means (22) along the length of said rotatable shaft (21) whereby during the immersion of the flow effecting means (22) in the substance (5), the grinding device (3) can be selectively submerged in or retracted from the substance (5) while the flow effecting means (22) remains immersed therein.

2. The dispersing device as defined in claim 1 wherein said flow effecting means (22) is constructed and arranged for dissolving the substance (5).

3. The dispersing device as defined in claim 1 wherein said flow effecting means (22) is a dissolver disc (22).

4. The dispersing device as defined in claim 1 wherein said flow effecting means (22) includes means (23) for dissolving the substance (5).

5. The dispersing device as defined in claim 4 wherein said variable adjusting means (39) include bars (39) connected to said grinding device (3), and means for selectively moving said bars (39) in either of two directions along said rotatable shaft (2).

6. The dispersing device as defined in claim 1 wherein said flow effecting means (22) includes means (23) for dissolving the substance (5), and said substance dissolving means (23) are a plurality of teeth.

7. The dispersing device as defined in claim 1 including a second shaft (37) for rotating at least a portion (35) of said grinding device (3).

8. The dispersing device as defined in claim 7 wherein one of said shafts is hollow, and the other of said shafts is located in said one hollow shaft.

9. The dispersing device as defined in claim 7 wherein said first-mentioned rotatable shaft (21) passes through said perforated casing (31).

10. The dispersing device as defined in claim 9 wherein one of said shafts is hollow, and the other of said shafts is located in said one hollow shaft.

11. The dispersing device as defined-in claim 7 wherein said perforated casing (31) is of an annular configuration defining a central opening (34), and said first-mentioned rotatable shaft passes through said central opening (34).

12. The dispersing device as defined in claim 11 wherein one of said first-mentioned (21) and second (37) shafts is hollow, and the other of said first-mentioned (21) and second (37) shafts is located in said one hollow shaft.

13. The dispersing device as defined in claim 7 wherein said grinding device (3) includes a rotatable second shaft (37) carrying agitating means (35) located in said perforated casing (31) for agitating the substance (5) during rotation of said second shaft (37).

14. The dispersing device as defined in claim 7 wherein said grinding device (3) includes a rotatable second shaft (37) carrying agitating means (35) located in said perforated casing (31) for agitating the substance (5) during rotation of said second shaft (37), an annular opening (33) in said perforated casing (31) and a web (36) connecting said rotatable second shaft (37) to said agitating means (35) through said annular opening.

15. The dispersing device as defined in claim 7 wherein said variable adjusting means (39) include bars (39) connected to said grinding device (3), and means for selectively moving said bars (39) in either of two directions along said rotatable shaft (2).

16. The dispersing device as defined in claim 1 wherein said rotatable shaft (21) passes through said perforated casing (31).

17. The dispersing device as defined in claim 1 wherein said perforated casing (31) is of an annular configuration defining a control opening (34), and said rotatable shaft passes through said central opening (34).

18. The dispersing device as defined in claim 1 wherein said grinding device (3) includes a rotatable second shaft (37) carrying agitating means (35) located in said perforated casing (31) for agitating the substance (5) during rotation of said second shaft (37).

19. The dispersing device as defined in claim 18 wherein one of said first-mentioned (21) and second (37) shafts is hollow, and the other of said first-mentioned (21) and second (37) shafts is located in said one hollow shaft.

20. The dispersing device as defined in claim 18 wherein said agitating means includes at least one disc (35).

21. The dispersing device as defined in claim 20 wherein one of said shafts is hollow, and the other of said shafts is located in said one hollow shaft.

22. The dispersing device as defined in claim 1 wherein said grinding device (3) includes a rotatable second shaft (37) carrying agitating means (35) located in said perforated casing (31) for agitating the substance (5) during rotation of said second shaft (37), an annular opening (33) in said perforated casing (31) and a web (36) connecting said rotatable second shaft (37) to said agitating means (35) through said annular opening.

23. The dispersing device as defined in claim 22 wherein one of said first-mentioned (21) and second (37) shafts is hollow, and the other of said first-mentioned (21) and second (37) shafts is located in said one hollow shaft.

24. A process of successively pre-dispersing and fine dispersing solid particulate material in a substance (5) comprising the steps of providing a container (1) housing a rotatable dissolver (2) for pre-dispersing and a rotatable ball mill (3) for fine dispersing, loading the substance (5) into the container (1) rotating the dissolver (2) while immersed in the substance (5) to effect pre-dispersing thereof while the ball mill (3) is above the substance (5), lowering the ball mill (3) toward the dissolver (2) and relative thereto into the substance (5), and rotating the ball mill (3) in the substance (5) to effect fine dispersing thereof.

25. The process as defined in claim 24 including rotating the dissolver (2) during the rotation of the ball mill (3) while both are immersed in the substance (5).

26. The process as defined in claim 25 including holding the rotatable ball mill (3) stationary when located above the substance (5).

27. The process as defined in claim 26 including rotating the dissolver 92) and ball mill (3) about a common axis.

28. The process as defined in claim 26 including rotating the dissolver 92) and ball mill (3) about a common axis, and moving the ball mill (3) relative to the dissolver (2) along the common axis.

29. The process as defined in claim 25 including rotating the dissolver 92) and ball mill (3) about a common axis.

30. The process as defined in claim 25 including rotating the dissolver 92) and ball mill (3) about a common axis, and moving the ball mill (3) relative to the dissolver (2) along the common axis.

31. The process as defined in claim 24 including holding the rotatable ball mill (3) stationary when located above the substance (5).

32. The process as defined in claim 24 including rotating the dissolver 92) and ball mill (3) about a common axis.

33. The process as defined in claim 24 including rotating the dissolver 92) and ball mill (3) about a common axis, and moving the ball mill (3) relative to the dissolver (2) along the common axis.

* * * * *

UNITED STATES PATENT AND TRADEMARK OFFICE

CERTIFICATE OF CORRECTION

PATENT NO. : 5,967,430

DATED : October 19, 1999

INVENTOR(S) : Hermann Getzmann

It is certified that error appears in the above-identified patent and that said Letters Patent is hereby corrected as shown below:

Column 7, line 26, change "control" to --central--.

Signed and Sealed this

Nineteenth Day of September, 2000

*Attest:*

Q. TODD DICKINSON

*Attesting Officer*

*Director of Patents and Trademarks*